US005392576A

United States Patent [19]

Yeamans

[11] Patent Number: 5,392,576

[45] Date of Patent: Feb. 28, 1995

[54] ROOF DECK COVERING SYSTEM SECUREMENT MECHANISM

[76] Inventor: Robert C. Yeamans, 2777 Northwest, Columbus, Ohio 43221

[21] Appl. No.: 20,849

[22] Filed: Feb. 22, 1993

[51] Int. Cl.[6] ..... E04B 7/00; E04D 13/14

[52] U.S. Cl. ..... 52/408; 52/60; 52/273; 160/391

[58] Field of Search ..... 160/391, 392; 52/408 OR, 60, 58, 273

[56] References Cited

U.S. PATENT DOCUMENTS

| | | | |
|---|---|---|---|
| 3,237,352 | 3/1966 | Edwards | 52/60 |
| 3,549,471 | 12/1970 | Denton | 52/273 |
| 3,830,033 | 8/1974 | Gahler | 160/391 |
| 3,958,373 | 5/1976 | Stewart et al. | 52/273 |
| 4,662,129 | 5/1987 | Hickman | 52/60 |
| 4,781,008 | 11/1988 | Lyons, Jr. | 52/60 |
| 4,912,900 | 4/1990 | Yeamans | 52/60 |
| 4,996,801 | 3/1991 | Ristow et al. | 52/60 |
| 5,189,853 | 3/1993 | Braine et al. | 52/60 |
| 5,253,461 | 10/1993 | Janoski et al. | 52/408 |

*Primary Examiner*—Carl D. Friedman
*Assistant Examiner*—Wynn E. Wood
*Attorney, Agent, or Firm*—John L. Gray

[57] ABSTRACT

A roof deck covering system with a means for securing a roof membrane over a roof deck, either at the periphery or in the interior of a roof, and holding it in place for an indefinite period of time and not affecting the watertight integrity of the membrane.

2 Claims, 3 Drawing Sheets

ROOF DECK COVERING SYSTEM SECUREMENT MECHANISM

BACKGROUND OF THE INVENTION

Applicant has invented a new roof deck covering system as set forth in U.S. Pat. No. 4,926,596 and has also invented perimeter securement assemblies for securing the roof deck covering system shown in that patent. These are set forth in U.S. Pat. Nos. 4,912,900 and 5,025,604.

An important advantage of these securement systems involves the fact that the membrane covering on the roof is not punctured in securing it over the roof deck. Applicant has improved on these securement systems in two ways. Applicant has found that it is preferable in extremely large roof systems to be able to secure the membrane and the apertured overlay in areas of the roof other than at the periphery and around roof top units. Applicant has also found that it is desirable in the construction of a roof deck covering system of his type to be able to secure the membrane independently of securing the overlay.

SUMMARY OF INVENTION

Applicant's invention comprises a means for securing a roof membrane over a roof deck, either at the periphery or in the interior of a roof, and holding it in place for an indefinite period of time and not affecting the watertight integrity of the membrane.

It is therefore an object of this invention to provide a mechanism for retaining a waterproof membrane securely over a roof deck either at the periphery or in the interior of the roof.

It is a further object of this invention to provide such a device which preserves the watertight integrity of the membrane.

These, together with other objects and advantages of the invention will become more readily apparent to those skilled in the art when the following general statements and descriptions are read in the light of the appended drawings.

DETAILED DESCRIPTION OF THE INVENTION

Figure 1:
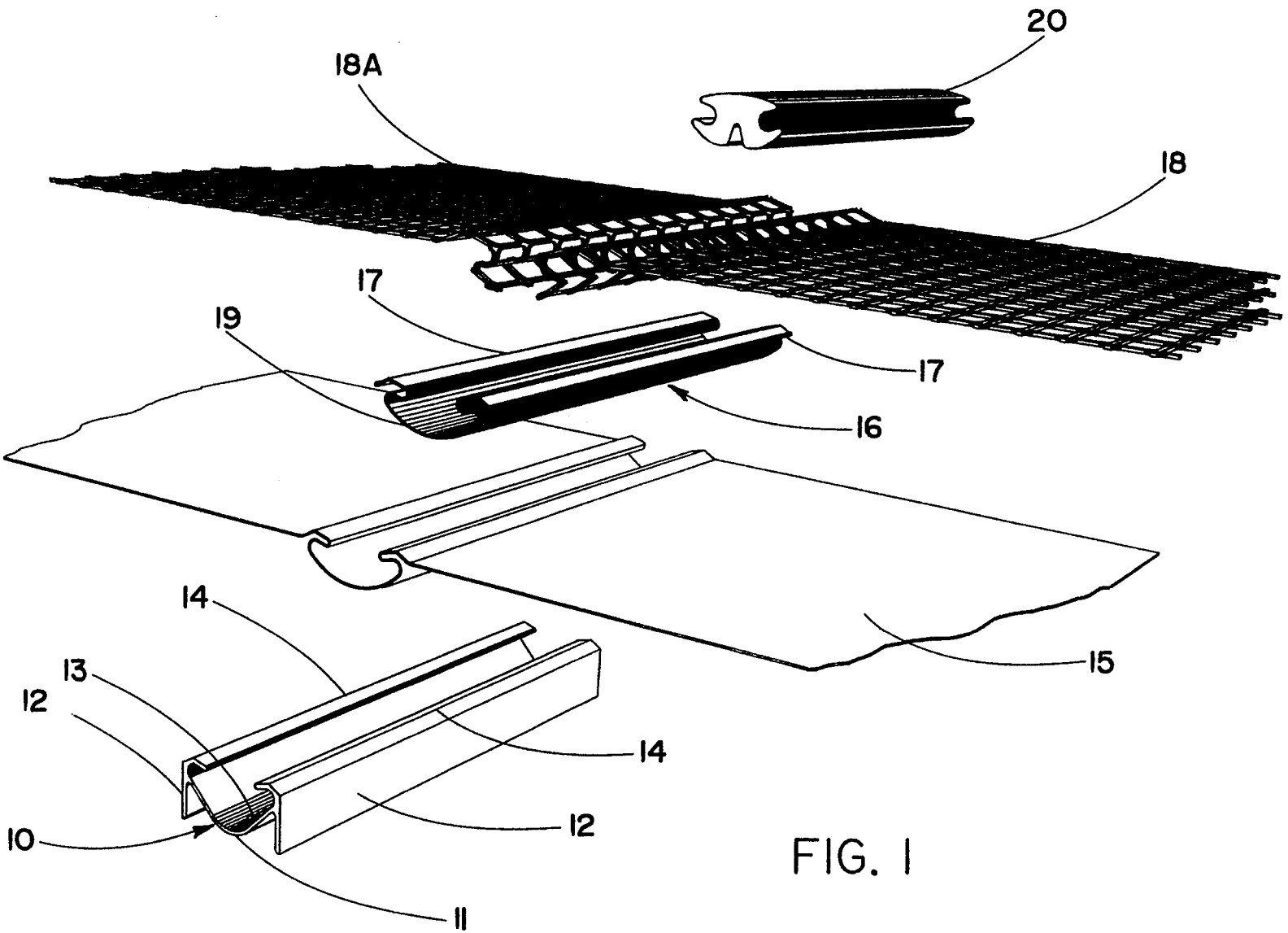
FIG. 1 is an exploded perspective view of applicant's invention as applied to the interior of a roof.

Referring now more particularly to FIG. 1, applicant's invention comprises a base member shown generally at 10 having a curved linear extending portion 11. This may be provided with linear extending supports 12—12 if desired. The base member 10 is secured to the roof deck by means of fasteners such as screws 13—13. The device is provided with oppositely positioned elements 14—14 extending toward each other as shown. 15 is the membrane as it would appear positioned in element 10. Member 16 is a compression flange which is resilient and conforms to the interior shape of member 10 and is capable of being forced down onto the membrane 15 which is positioned in member 10. The portions 17—17 of compression flange 16 conform to the elements 14—14 of base member 10 and when snapped in place will effectively retain the membrane 15. The apertured overlay 18 may, if desired, be split into two sections 18 and **18*a*. In that case, as shown in FIG. 1, the apertured overlay portions 18 and 18*a* may then be formed around portions 17—17 of compression flange 16 with the edges of apertured overlay 18 and 18*a* ending in recessed portion 19 and the portions 18 and 18*a* being then held in place with the retainer 20 which is comparable to the retainer 22 or 21 of U.S. Pat. Nos. 5,025,604 or 4,912,900, respectively. Of course, the apertured overlay 18 may also be retained as a single member in which case it may be forced down into the recessed portion 19**.

By utilizing compression flange 16 in assembling a roof deck covering system of the type set forth in U.S. Pat. No. 4,926,596, it is possible to secure the entire membrane portion over the roof deck and even permit it to be held for some indefinite period of time until the apertured overlay 18 is positioned thereover and is held in place by the retainer 20.

Figure 2:
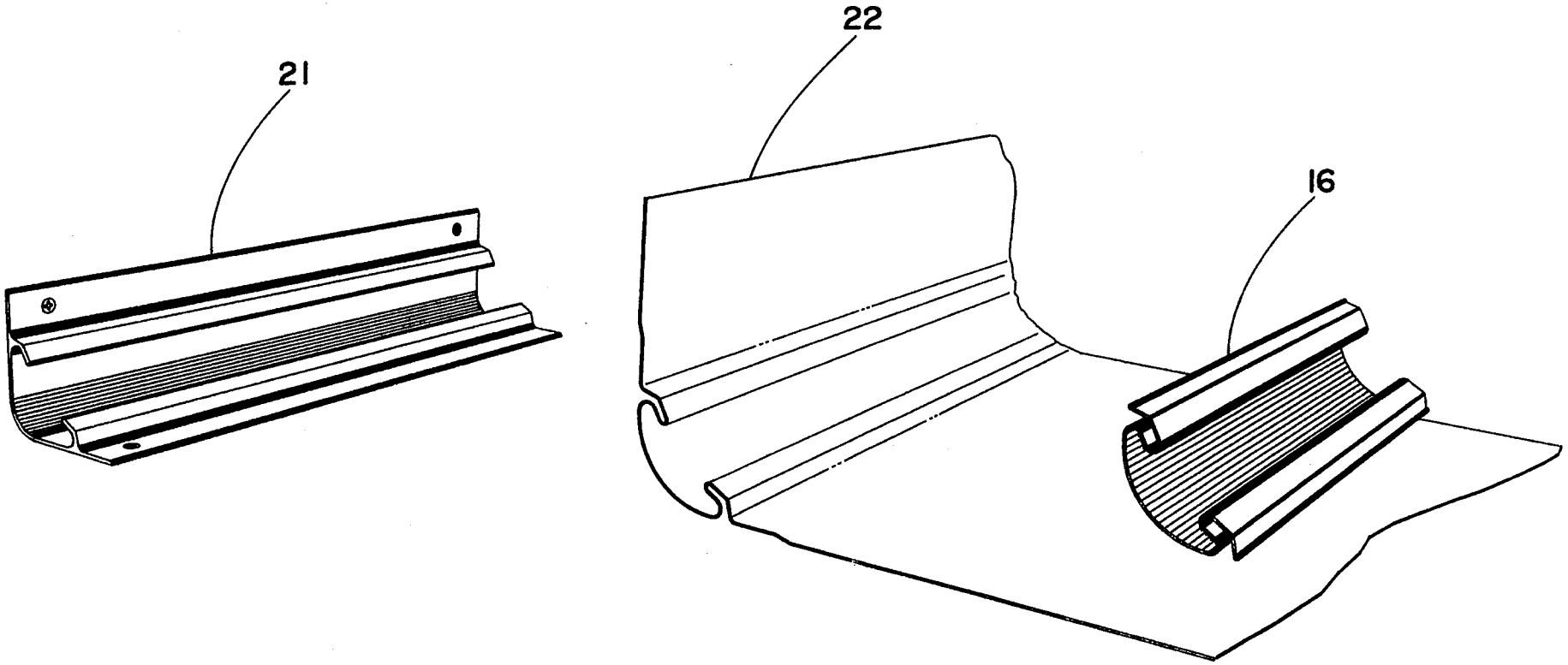
FIG. 2 is an exploded perspective view of applicant's invention as applied to the periphery of a roof.

Referring now more particularly to FIG. 2, there is shown a peripheral securement member 21 such as is disclosed in U.S. Pat. Nos. 5,025,604 and 4,912,900. Membrane 22 is shown as it would be shaped if positioned in member 21. Applicant's compression flange 16 is shown which could be positioned in member 21 holding membrane 22 in position similar to the manner as set forth in the description of the elements shown in FIG. 1.

Figure 3:
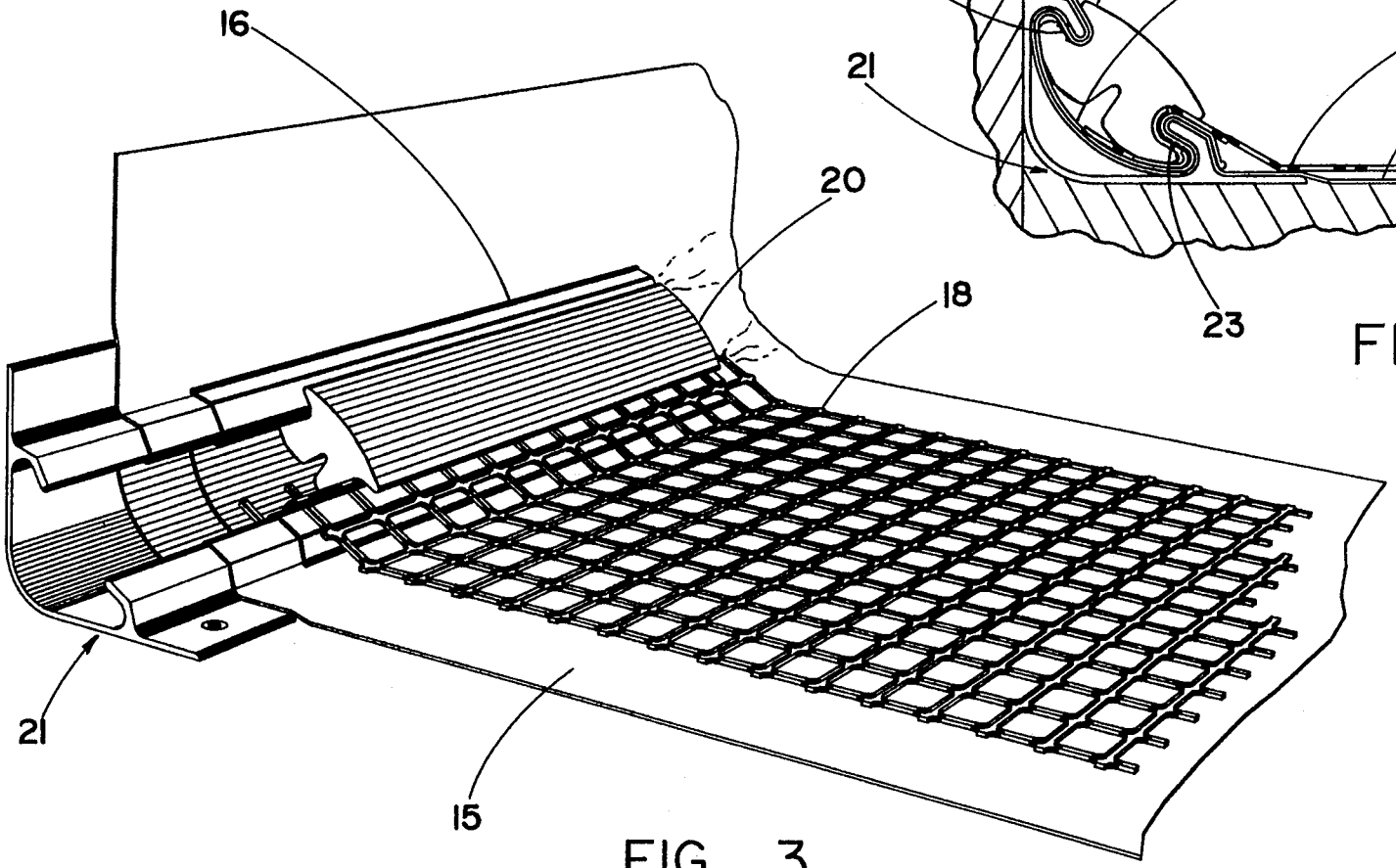
FIG. 3 shows applicant's invention with the membrane and the apertured overlay fully secured in a periphery securement assembly.

FIG. 3 shows the peripheral assembly member 21 with the membrane 15 held in place by compression flange 16 and the apertured overlay 18 is held in place by the retainer 20, similar to the manner as set forth in the description of the elements shown in FIG. 1.

Figure 4:
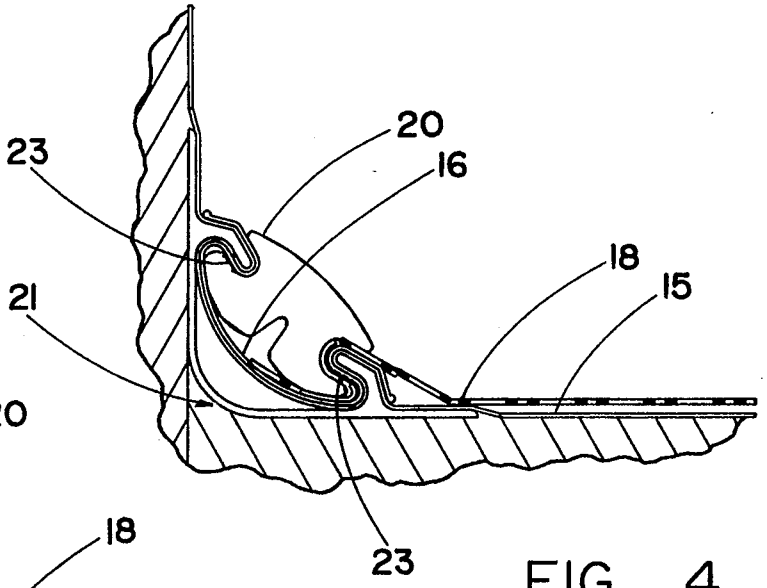
FIG. 4 is an end section of FIG. 3.

Referring now to FIG. 4, it will be noted that compression flange 16 is provided with a plurality of longitudinally extending ridges 23—23 which significantly increase the holding power of compression flange 16 in holding retainer 20 and thereby the membrane 15 in place.

Thus, it will be seen that applicant has invented a system which may be used either at the periphery of a roof or the interior of a roof to retain a waterproof membrane in place without affecting the watertight integrity of said membrane.

While this invention has been described in its preferred embodiment, it is to be appreciated that variations therefrom may be made without departing from the true scope and spirit of the invention.

What is claimed:

1. In a roof deck covering system comprising a waterproofing membrane positioned on the surface of said roof deck and an apertured overlay positioned on top of said waterproofing membrane and essentially coextensive therewith, a securement assembly for said roof deck covering for securely retaining said waterproofing membrane over said roof deck comprising, a base member capable of being firmly attached to said roof deck and including a curved linear extending portion designed to extend along said roof deck provided with two oppositely positioned edges thereon, said curved linear extending portion of said base member provided with means adapting said base member to be tangentially secured to the surface of said roof deck, a first element at one edge of said curved linear extending portion extending in a direction toward said other edge of said curved linear extending portion and a second element at the other edge of said curved linear extending portion extending in a direction toward said one edge of said curved linear extending portion and having a length much greater than the distance between said one edge and said other edge of said curved linear extending portion, and a first resilient means having a thickness approximately that of said waterproofing membrane and of a shape substantially conforming to that portion of said base member between said one edge and said other edge of said curved linear extending portion and having a length much greater than the distance between said one edge and said other edge of said curved linear extending portion and adapted to press said waterproofing membrane securely against said base member between said one edge and said other edge of said curved linear extending portion.

2. The securement assembly of claim 1 including a second resilient means of a shape conforming to the shape of said first resilient means, wherein said first resilient means is adapted to hold said waterproofing membrane against said base member between said one edge and said other edge of said curved linear extending portion of said base member, and said second resilient means is adapted to hold said apertured overlay against that portion of said first resilient means being held against said waterproofing membrane being held against said base member between said one edge and said other edge of said curved linear extending portion of said base member.

* * * * *